US008389912B2

(12) United States Patent
Niiyama et al.

(10) Patent No.: US 8,389,912 B2
(45) Date of Patent: Mar. 5, 2013

(54) INDUCTION COOKER

(75) Inventors: Koji Niiyama, Hyogo (JP); Keiko Isoda, Hyogo (JP); Masamichi Komada, Hyogo (JP)

(73) Assignee: Panasonic Corporation, Osaka (JP)

( * ) Notice: Subject to any disclaimer, the term of this patent is extended or adjusted under 35 U.S.C. 154(b) by 471 days.

(21) Appl. No.: 12/666,100

(22) PCT Filed: Jun. 23, 2008

(86) PCT No.: PCT/JP2008/001615
§ 371 (c)(1),
(2), (4) Date: Dec. 22, 2009

(87) PCT Pub. No.: WO2009/001540
PCT Pub. Date: Dec. 31, 2008

(65) Prior Publication Data

US 2010/0181299 A1 Jul. 22, 2010

(30) Foreign Application Priority Data

Jun. 22, 2007 (JP) ..... 2007-164611

(51) Int. Cl.
*H05B 6/12* (2006.01)

(52) U.S. Cl. ..... 219/620; 219/502

(58) Field of Classification Search ..... 219/620, 219/627, 502, 490, 622, 625; 374/121
See application file for complete search history.

(56) References Cited

U.S. PATENT DOCUMENTS 5,648,008 A * 7/1997 Barritt et al. ..... 219/626
(Continued)

FOREIGN PATENT DOCUMENTS

JP 60104993 7/1985
JP 2057035 4/1990
(Continued)

OTHER PUBLICATIONS

International Search Report issued Sep. 9, 2008 in International (PCT) Application No. PCT/JP2008/001615.
(Continued)

*Primary Examiner* — Caridad Everhart
(74) *Attorney, Agent, or Firm* — Wenderoth, Lind & Ponack, L.L.P.

(57) ABSTRACT

There is provided an induction cooker capable of detecting failures in an infrared ray sensor with excellent accuracy. The induction cooker includes an infrared-ray detection unit (6) which includes an infrared-ray incidence section (6*a*) to detect an infrared ray entering the infrared-ray incidence section, the infrared ray being radiated from a bottom surface of a pan, passing through a top plate, and entering the infrared-ray incidence section; a infrared-ray temperature calculation unit (7) operable to calculate a temperature of the bottom surface of the pan based on an output of the infrared-ray detection unit; a light emitting unit (8) which is provided below the top plate and emits light with a first luminance for indicating a position of the infrared-ray incidence section (6*a*); and a failure detection unit (9) operable to detect failures in the infrared-ray detection unit based on an amount of a change of an output of the infrared-ray temperature calculation unit which is based on an output of the light emitting unit. The failure detection unit (9) controls the light emitting unit to emit light with a second luminance higher than the first luminance and detects failures in the infrared-ray detection unit based on whether or not an amount of an increase in the output of the temperature calculation unit falls within a predetermined range.

8 Claims, 3 Drawing Sheets

U.S. PATENT DOCUMENTS

| | | | | |
|---|---|---|---|---|
| 5,958,271 | A * | 9/1999 | Westerberg et al. | 219/413 |
| 6,132,084 | A * | 10/2000 | Whipple et al. | 374/131 |
| 6,140,617 | A * | 10/2000 | Berkcan et al. | 219/446.1 |
| 6,169,486 | B1 * | 1/2001 | Berkcan et al. | 340/584 |
| 6,403,932 | B1 * | 6/2002 | Nelson et al. | 219/497 |
| 6,417,513 | B1 * | 7/2002 | Hershey et al. | 250/338.5 |
| 6,452,136 | B1 * | 9/2002 | Berkcan et al. | 219/502 |
| 2002/0130190 | A1 * | 9/2002 | Marbach et al. | 236/20 R |
| 2003/0164370 | A1 * | 9/2003 | Aihara et al. | 219/622 |
| 2007/0080158 | A1 * | 4/2007 | Takimoto | 219/627 |
| 2009/0134149 | A1 | 5/2009 | Keishima et al. | |

FOREIGN PATENT DOCUMENTS

| | | |
|---|---|---|
| JP | 2105132 | 8/1990 |
| JP | 3-289086 | 12/1991 |
| JP | 2004-227839 | 8/2004 |
| JP | 2004-241218 | 8/2004 |
| JP | 2004-327053 | 11/2004 |
| JP | 2004-355895 | 12/2004 |
| JP | 2005-216585 | 8/2005 |
| JP | 2006-294286 | 10/2006 |
| WO | 2007/055218 | 5/2007 |

OTHER PUBLICATIONS

An English translation of the International Preliminary Report on Patentability and Written Opinion of the International Searching Authority issued Jan. 12, 2010 in International (PCT) Application No. PCT/JP2008/001615.

Extended European Search Report issued Jun. 4, 2012 in European Application No. 08764198.1.

* cited by examiner

2

INDUCTION COOKER

TECHNICAL FIELD

The present invention relates to an induction cooker using an infrared ray sensor for use in ordinary households or restaurants.

BACKGROUND ART

Conventional induction cookers have generally utilized methods for indirectly detecting a temperature of a bottom of a pan, by bringing a thermosensor such as a thermistor into contact with a top plate on which the pan is placed. Further, as a detection method with more excellent responsivity, there has been utilized a method for detecting intensity of infrared rays outputted from a bottom of a pan, using an infrared ray sensor. When an infrared ray sensor is used, there are cases where the temperature cannot be accurately detected, as follows.

For example, when the infrared ray sensor is contaminated, it is impossible to accurately detect the temperature. Therefore, there has been contrived a method for determining the contamination of an infrared ray sensor, using a contamination detection section formed from a combination of an infrared-ray TED and a photo transistor, based on a reduction of an amount of light reflected by the surface layer of the top plate due to absorption of infrared rays by the contamination of the infrared ray sensor. Further, there has been a method for detecting the contamination of an infrared-ray receiving portion and correcting an actual temperature of radiation from an object to be heated, by using a temperature detected by the infrared ray sensor and a temperature detected by a thermosensor which is thermally contacted with the object to be heated (refer to Patent document 1, for example).

For example, when there is a failure in the infrared ray sensor, it is impossible to accurately detect the temperature. Therefore, there has been a method which determines that there is an abnormality and stops heating or reducing the heating power, if a value of an output of an infrared ray sensor exceeds a predetermined range. Further, there has been contrived a method which provides a thermosensor such as a thermistor for detecting the temperature of an infrared-ray sensor or a peripheral temperature around the infrared ray sensor and determines that there is an abnormality if the temperature from the thermosensor exceeds a predetermined range (refer to Patent document 2, for example).

Patent document 1: JP-A-2004-241218

Patent document 2: JP-A-2005-216585

SUMMARY OF INVENTION

Problems to be Solved by the Invention

However, in the related art, there has been a problem that an amount of light entering the infrared ray sensor is changed depending on the brightness of the top plate, presence or absence of a pan on the top plate, and the temperature of the pan bottom, which makes it impossible to successfully detect failures. Further, in the case of the structure including an infrared ray LED and a photo transistor in addition to the infrared ray sensor, the structure has been expensive and also has required a large area for mounting the components and restricted the shape of the heating coil, thereby reducing heating performance.

In the case of correcting the infrared ray sensor using the thermosensor, when the temperature of the pan bottom is lower, there are small differences among amounts of infrared rays which can be detected along with the temperature, which has induced a problem that an object to be heated has to be actually heated to a high temperature, otherwise it is impossible to perform correction using the thermosensor and detection of the contamination of the light receiving portion of the infrared ray sensor. Further, there has been a problem that, in cases where the pan bottom has been largely deformed or the like, it is hard to accurately detect the temperature of the pan bottom, even if correction is performed with the thermosensor. Further, there has been a problem that it is significantly hard to limit the range of the output of the infrared ray sensor, due to an influence of disturbing light.

As described above, with conventional methods, it has been impossible to detect failures in an infrared ray sensor with excellent accuracy.

The present invention has been made in to solve the aforementioned problems in the related art and aims at providing an induction cooker capable of detecting failures in an infrared ray sensor with excellent accuracy.

Means for Solving the Problems

In order to solve the conventional problems, an induction cooker according to the present invention includes: a top plate made of a material capable of transmitting an infrared ray; a heating coil operable to heat a pan placed on the top plate; a control unit operable to control electric power supplied to the heating coil; an infrared-ray detection unit which includes an infrared-ray incidence section below the top plate to detect an infrared ray entering the infrared-ray incidence section, the infrared ray being radiated from a bottom surface of the pan, passing through the top plate, and entering the infrared-ray incidence section; a temperature calculation unit operable to calculate a temperature of the bottom surface of the pan based on an output of the infrared-ray detection unit; a light emitting unit operable to emit light with a first luminance near the infrared-ray incidence section when viewed from above the top plate by irradiating the back surface of the top plate from below the top plate with light, to indicate a position of the infrared-ray incidence section; and a failure detection unit operable to detect a failure in the infrared-ray detection unit based on an amount of a change of an output of the temperature calculation unit which is based on an output of the light emitting unit. The light emitting unit includes a luminance changing section operable to change the luminance of the light emission, and the failure detection unit controls the light emitting unit to emit light with a second luminance higher than the first luminance and detects a failure in the infrared-ray detection unit, based on whether or not an amount of an increase in the output of the temperature calculation unit falls within a predetermined range.

The failure detection unit performs failure detection by controlling the light emitting unit to emit light with a high luminance through the luminance changing section. This can increase detection accuracy of the failure detection.

Further, it is possible to employ a structure which the infrared-ray incidence section is covered with a pan when the light emitting unit is covered with the pan, for example, a structure which provides the infrared-ray incidence section between the center of the heating coil and the light emitting unit on a straight line connecting the center of the heating coil with the light emitting unit. In this case, when the pan is not positioned over the infrared-ray incidence section, a user can easily recognize that the pan is not positioned over the infrared-ray incidence section through the light emission from the light emitting unit. That is, the light emission from the light emitting unit functions to urge the user to place the pan over the infrared-ray incidence section. Accordingly, since the failure detection is performed with the high-luminance light emission before start of heating, it is possible to offer the effect of causing the pan to be placed at an appropriate position, thereby further improving the accuracy of detection of infrared rays by the infrared-ray detection unit, after the start of heating.

The failure detection unit may perform failure detection by controlling the light emitting unit to turn off the light.

The failure detection unit may perform failure detection a plurality of times by controlling the light emitting unit to blink on and off. This can increase the accuracy of failure detection and also improve a visual effect.

The failure detection unit may acquire a plurality of output values from the infrared-ray detection unit which are based on a predetermined amount of light emission from the light emitting unit and perform failure detection only when the output values from the infrared-ray detection unit fall within a predetermined range. This can reduce the occurrence of erroneous detections. For example, it is possible to prevent erroneous failure detections at a state where a person moves and disturbing light is changed.

The induction cooker may further include a shield section operable to interrupt the infrared ray entering the infrared-ray incidence section from the top plate, while the failure detection unit performs failure detection.

The failure detection unit performs failure detection, immediately before the control unit starts heating. This enables detection of failures immediately before the use of the cooker at all times, thereby improving the safety.

When the failure detection unit determines that there is a failure in the infrared-ray detection unit, the control unit may stop heating. This can improve the safety.

The induction cooker may further include a notification section operable to give notice that there is a failure in the infrared-ray detection unit when the failure detection unit determines that there is a failure in the infrared-ray detection unit. For example, it is possible to inform the user of the fact that there is a failure in the infrared-ray detection unit, through an LCD, a buzzer or a voice notification. This can improve the safety.

Effects of the Invention

According to the induction cooker of the present invention, the detection of failures in the infrared-ray detection unit is performed based on the amount of the change of the output of the temperature calculation unit which is based on the output of the light emitting unit. This enables detection of failures in the infrared-ray detection unit with excellent accuracy.

DESCRIPTION OF REFERENCE NUMERALS

Figure 1:
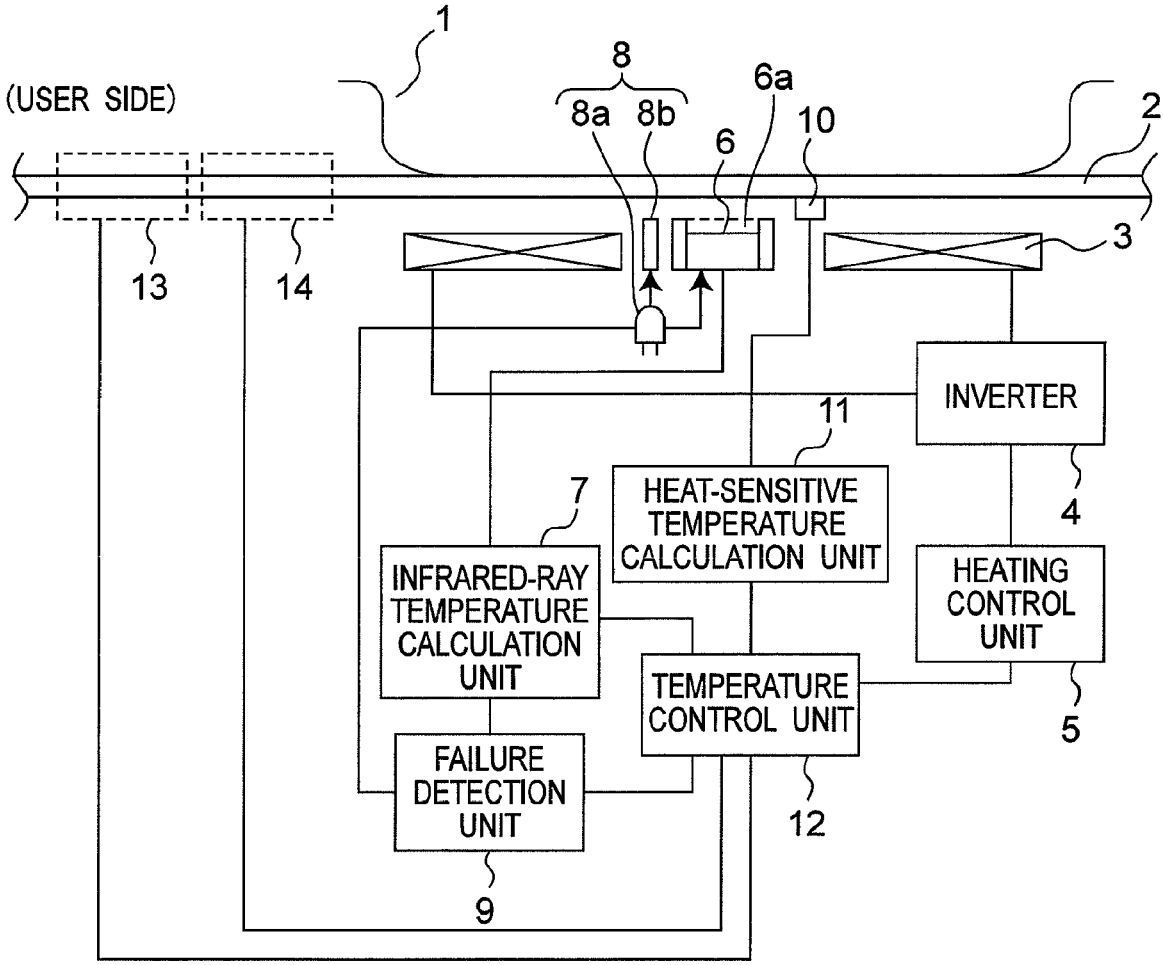
FIG. 1 is a block diagram of an induction cooker according to an embodiment of the present invention.

1 pan
2 top plate
3 heating coil
4 inverter
5 heating control unit
6 infrared-ray detection unit
6*a* infrared-ray incidence section
7 infrared-ray temperature calculation unit
8 light emitting unit
8*a* light emitter
8*b* light guiding member
9 failure detection unit
10 thermosensor
11 heat-sensitive temperature calculation unit
12 temperature control unit
13 operation section
14 notification section

DETAILED DESCRIPTION OF THE INVENTION

Hereinafter, an embodiment of the present invention will be described, with reference to the drawings. Note that the present invention is not intended to be limited to the embodiment.

1. Structure of Induction Cooker

FIG. 1 is a block diagram illustrating a structure of an induction cooker according to the present embodiment. The induction cooker according to the present embodiment includes a top plate 2 for placing a pan 1 thereon, a heating coil 3 which heats the pan 1, an inverter 4 which supplies a high-frequency current to the heating coil 3 to cause the pan 1 to generate heat through electromagnetic induction, and a heating control unit (a control unit) 5 which controls the inverter 4.

The top plate 2 is made of a glass-ceramic or the like which efficiently transmits infrared rays having a wavelength range equal to or shorter than 2.5 μm. The induction cooker includes an infrared-ray detection unit 6 which detects infrared rays radiated from the bottom surface of the pan 1. The infrared-ray detection unit 6 is an infrared ray sensor having a photo diode or the like which can detect wavelengths equal to or shorter than 2.5 μm, for example. The infrared-ray detection unit 6 includes an infrared-ray incidence section 6*a* for infrared rays which is radiated from the bottom surface of the pan 1, passes through the top plate 2, and enters the infrared-ray incidence section 6*a*. The infrared-ray incidence section 6*a* is provided below the top plate 2. A through hole is provided inside the infrared-ray detection unit 6, and the upper opening of the through hole corresponds to the infrared-ray incidence section 6*a*. The infrared-ray detection unit 6 includes an infrared-ray receiving element in the lower opening of the through hole provided therein. The infrared-ray detection unit 6 directs the infrared rays entering the infrared-ray incidence section 6*a* to the infrared-ray receiving element to narrow the field of view of the infrared-ray receiving element. As described above, the infrared-ray detection unit 6 has a structure which gathers infrared rays radiated from the narrow range in the bottom surface of the pan 1, while interrupting infrared rays or disturbing light from the portion other than the pan 1. The output from the infrared-ray detection unit 6 is calculated by an infrared-ray temperature calculation unit 7 and converted into the temperature of the bottom surface of the pan.

Below the top plate 2, there is provided a light emitting unit 8 for indicating the position of the infrared-ray incidence section 6*a*. The light emitting unit 8 includes an light emitter 8*a* such as an LED, and a light guiding member 8*b* which receives light from the light emitter 8*a* at a lower surface thereof and radiates the light from a light emission surface at an upper end toward the back surface of the top plate 2. The light emission from the light emitting unit 8 informs a user of the position of the infrared-ray incidence section 6*a*. A portion of the light radiated from the light emitter 8*a* with, the amount of which is not large, also reaches lateral portions, and the infrared-ray detection unit 6 is structured to be capable of detecting such light. The light emitting unit 8 includes a luminance changing section (not shown) which changes the luminance for performing turn-off of light, light emission with a low luminance and light emission with a high luminance. In the present embodiment, while the power supply of the induction cooker is on, the light emitting unit 8 emits light with a low luminance for indicating the position of the infrared-ray incidence section 6*a*. Note that the low-luminance light emission may be divided into a plurality of stages. In this case, when it can be determined that no cooking is being performed, it is possible to perform light emission in a lower stage, out of the plurality of stages of low-luminance light emission. This can alleviate the reduction of the life of the light emitter 8*a*.

The induction cooker according to the present embodiment further includes a failure detection unit 9 which detects failures in the infrared-ray detection unit 6, based on the amount of the change of the output from the infrared-ray temperature calculation unit 7 which is based on the output from the light emitting unit 8. In the present embodiment, the failure detection unit 9 detects failures, by making a comparison between the temperatures detected by the infrared-ray temperature calculation unit 7 at a state where the light emitting unit 8 is turned off and at a state where the light emitting unit 8 emits light with a high luminance.

The induction cooker according to the present embodiment further includes a notification section 14 which gives notice that there is a failure in the infrared-ray detection unit 6, if the failure detection unit 9 determines that there is a failure in the infrared-ray detection unit 9. In the present embodiment, the notification section 14 is constituted by a display element such as an LCD or TED and is provided in the top plate 14. The notification section 14 may also be formed as a voice reproduction device.

Further, an operation section 13 is provided at a portion of the top plate 2 which is closer to the user. The operation section 13 is constituted by a plurality of key switches.

The induction cooker according to the present embodiment includes a thermosensor 10 such as a thermistor for detecting the temperature of the top plate 2, a heat-sensitive temperature calculation unit 11 which calculates the temperature based on the output of the thermosensor 10, and a temperature control unit 12 which performs temperature control suitable for cooking such as sauteing of foods, flying of fritter, boiling of water, cooking of rice and the like, based on the temperature calculated by the infrared-ray temperature calculation unit 7 and the temperature calculated by the heat-sensitive temperature calculation unit 11 and further operates to stop heating upon detecting an abnormally-high temperature. The temperature control unit 12 has a protecting function for stopping heating or reducing the electric power, if the output of the heat-sensitive temperature detection unit 12 becomes equal to or higher than a predetermined temperature (for example, 180° C.), similarly to a protecting function based on the infrared-ray temperature.

Figure 2:
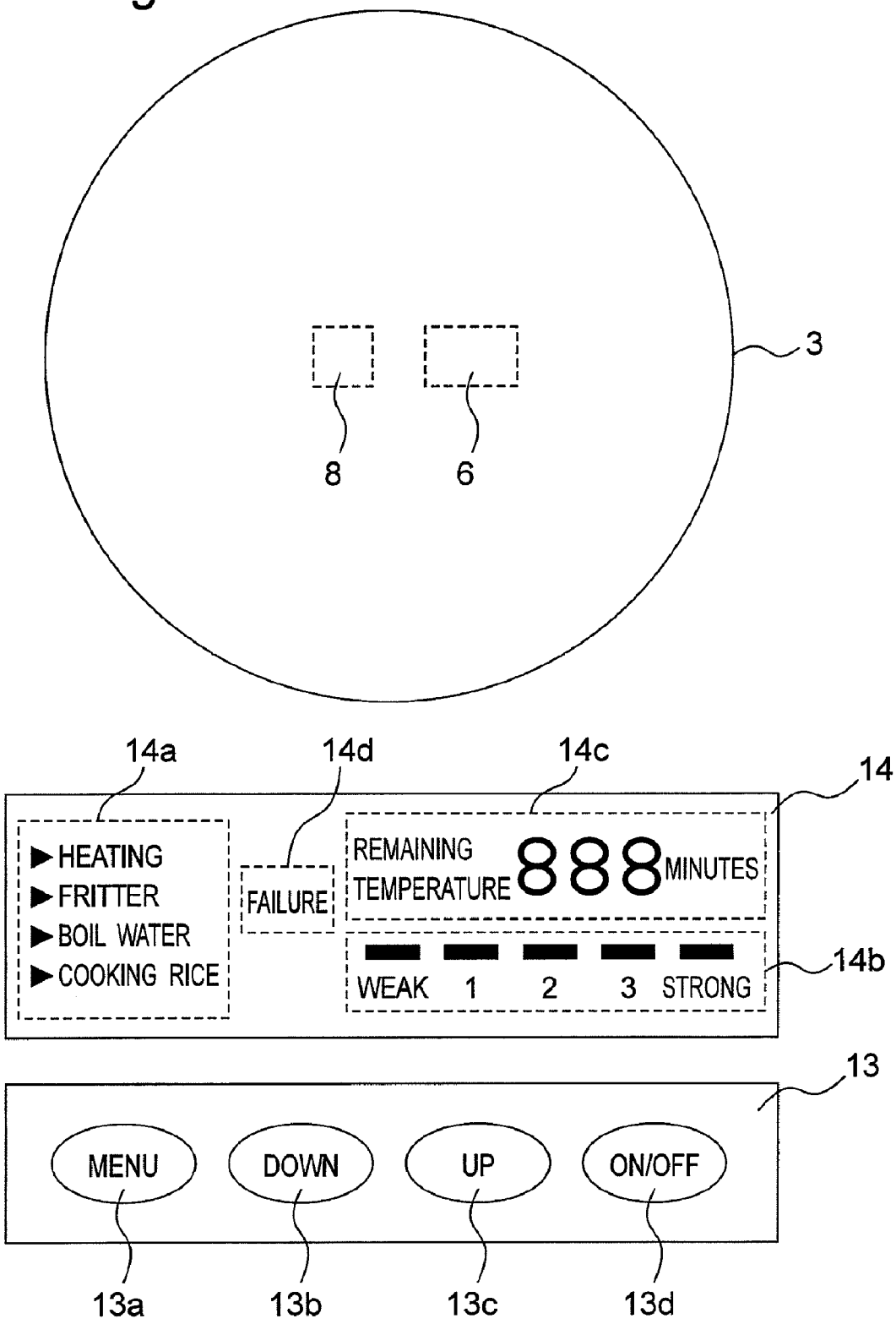
FIG. 2 is a top view of a top plate according to the embodiment of the present invention.

FIG. 2 is an external view of the top plate 2. The operation section 13 includes a MENU switch 13*a*, a DOWN switch 13*b*, an UP switch 13*c*, and an ON/OFF switch. The notification section 14 includes a menu display portion 14*a*, a heating-power display portion 14*b*, and a time/temperature display portion 14*c*. Further, the notification section 4 includes a failure display portion 14*d* which notifies the user that a failure has occurred in the infrared-ray detection unit 6, using an LCD display device.

2 Operations of the Induction Cooker

2.1 Heating Operation

In the induction cooker, when the power supply (not shown) is turned on, any of menus for sauteed-food, fritter, boil-water and cooking-rice is selected through the MENU switch 13*a*, and then the ON/OFF switch 13*d* is pushed to start cooking, the inverter 4 supplies electric power to the heating coil 3 under the control of the heating control unit 5. When the heating coil 3 is supplied with the electric power, the heating coil 3 generates an induction magnetic field, thereby heating the pan 1 on the top plate 2. The temperature of the pan 1 is raised by the induction heating.

If the temperature of the pan 1 is raised, the pan 1 radiates infrared rays along with the temperature thereof. Infrared rays radiated from the pan 1 pass through the top plate 2 and enter the infrared-ray detection unit 6. By using the infrared-ray detection unit 6, it is possible to detect the temperature of the bottom surface of the pan 1 with excellent accuracy. This enables the heating control unit 5 to stop the heating or reduce the heating power, before an occurrence of ignition even with only a small amount of oil.

2.2 Detection of Failures

Figures 3A, 3B, 3C, 3D, 3E:
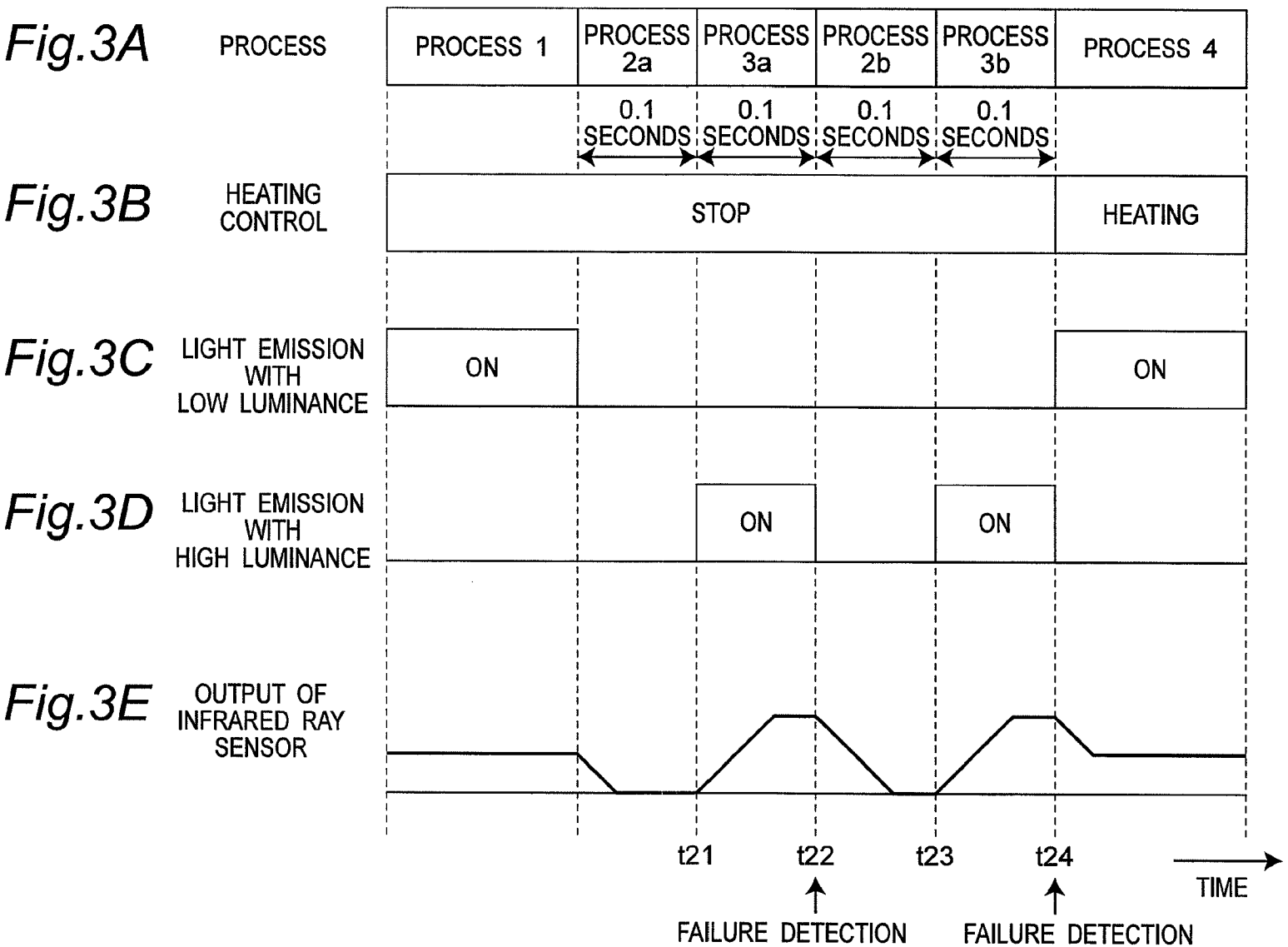
FIG. 3A, FIG. 3B, FIG. 3C, FIG. 3D, FIG. 3E are timing charts illustrating operations for failure detection according to the embodiment of the present invention.

The induction cooker according to the present embodiment performs detection of failures in the infrared-ray detection unit 6 before the start of heating. Operations of the failure detection unit 9 will be described, with reference to timing charts of FIG. 3A to FIG. 3E. FIG. 3A illustrates processes, FIG. 3B illustrates control of heating, FIG. 3C illustrates light emission with a low luminance, FIG. 3D illustrates light emission with a high luminance, and FIG. 3E illustrates the output of the infrared ray sensor. A process 1 is a heating-stopping process before start of heating, and a process 4 is a heating process. In the present embodiment, the detection of failure is performed twice, between the process 1 for stopping heating and the process 4 for heating (processes 2*a*, 3*a*, 2*b* and 3*b*). The processes 2*a*, 3*a*, 2*b* and 3*b* are each performed for 0.1 seconds, in the present embodiment.

In the process 2*a*, the light emitting unit 8 turns off the light emission. The failure detection unit 9 stores the output of the infrared-ray temperature calculation unit 7 at time $t_{21}$ after the elapse of 0.1 seconds since the turn off of the light emission. In the process 3*a*, the light emitting unit 8 emits light with a high luminance. The failure detection unit 9 makes a comparison between the output of the infrared-ray temperature calculation unit 7 at time $t_{22}$ after the elapse of 0.1 seconds since the start of the high-luminance light emission and the output of the infrared-ray temperature calculation unit 7 which has been stored at time t21 and determines whether or not the difference therebetween is equal to or more than a predetermined value. If the difference is equal to or more than the predetermined value, the failure detection unit 9 determines that there is a failure in the infrared-ray detection unit 6.

At time t22, the light emitting unit 8 turns off the light emission. The failure detection unit 9 stores the output of the infrared-ray temperature calculation unit 7 at time t23 after the elapse of 0.1 seconds since the turn off of the light emission. In the process 3*b*, the light emitting unit 8 emits light with a high luminance. The failure detection unit 9 determines whether or not the difference between the value of the output of the infrared-ray temperature calculation unit 7 at time t24 after the elapse of 0.1 seconds since the start of the high-luminance light emission and the value of the output of the infrared-ray temperature calculation unit 7 which has been stored at time t23 is equal to or more than a predetermined value. If the difference is equal to or more than the predetermined value, the failure detection unit 9 determines that there is a failure in the infrared-ray detection unit 6.

FIGS. 3A-3E illustrate a case where it is determined, based on the failure detections at time t22 and time t24, that there is no failure in the infrared-ray detection unit 6. Accordingly, heating is started after time t24. If the failure detection unit 9 determines, both at time t22 and time t24, that there is a failure in the infrared-ray detection unit 6, the heating control unit 5 does not start heating and causes the notification section 14 to notify the user that there is a failure in the infrared-ray detection unit 6.

As described above, in the present embodiment, detection of failures in the infrared-ray detection unit 6 is performed, based on the amount of the change of the output of the infrared-ray temperature calculation unit 7 which is based on the turn-off of the light emitting unit 8 and the high-luminance light emission from the light emitting unit 8. This enables detection of failures in the infrared-ray detection unit with excellent accuracy.

Further, immediately before the start of heating, detection of failures in the infrared-ray detection unit 6 is performed, and the light emitting unit 8 performs light emission with a higher luminance than in a normal state, which can urge the user to check whether or not the infrared-ray incidence section 6*a* is covered. Further, for example, when the infrared-ray incidence section 6*a* is placed between the light emitting unit 8 and the center of the heating coil 3 on the straight line which connects the light emitting unit 8 and the center of the heating coil 3 to each other when viewed from above, there is a high possibility that the infrared-ray incidence section 6*a* is covered with the bottom of the pan 1 if the light emitting unit is covered with the bottom of the pan 1. That is, when the pan 1 is placed at an appropriate position, the high-luminance light emission from the light emitting unit 8 is not visible, but when the pan 1 is not placed at an appropriate position, the high-luminance light emission from the light emitting unit 8 is visible. This can prevent the user from carelessly starting heating of the pan 1 placed at an improper position, which enables stable control of the temperature of the pan 1 through the infrared-ray detection unit 6. Note that, when the infrared-ray incidence section 6*a* is placed between the light emitting unit 8 and the center of the heating coil 3 on the straight line which connects the light emitting unit 8 and the center of the heating coil 3 to each other when viewed from above, if the straight line connecting the light emitting unit 8 and the center of the heating coil 3 to each other is made vertical to the front surface of the device and, also, the position of the light emitting unit 8 is placed at a position closer to the front surface of the device than the center of the heating coil, the light emitting unit 8 is less prone to be hidden by the pan 1 when the light emitting unit 8 is covered with the bottom of the pan 1. This further facilitates the operation for covering the light emitting unit 8 with the bottom surface of the pan 1.

Further, by making the luminance of the light emitting unit 8 higher than that of normal light emission, it is possible to increase the accuracy of the failure detection. Further, even if the luminance is increased, only a short time is required for detecting failures, which prevents the life of the light emitting unit 8 from being adversely affected thereby.

Further, it is also possible to prevent heating from being started, when there is a failure in the infrared-ray detection unit 6. This can prevent the ignition of oil due to the start of heating during cooking, for example. Further, the notification section 14 notifies the user that there is a failure in the infrared-ray detection unit 6. This can improve the safety and can also improve the convenience. Also, it is possible to cause the light emitting unit 8 to perform display in a flashing manner, which enables the user to easily recognize the position of the infrared-ray incidence section 6*a*, thereby further improving the usability.

3. Examples of Modifications

Although, in the present embodiment, failure detection is performed twice and, only if it is determined twice continuously that there is a failure, it is decided that there is a failure, and the start of heating is prevented (the stop of heating is maintained), the number of failure detections is not limited to that in the present embodiment. For example, if it is determined, continuous two or more times out of a predetermined number of detections (for example, five times), that the infrared-ray detection unit is normal, it may be determined that there is no failure therein, and otherwise, it may be determined that there is a failure therein. This enables detection of failures with excellent accuracy.

It is also possible to make a comparison among a plurality of continuous values from the infrared-ray temperature calculation unit 7 at the same light emission state of the light emitting unit 8 (for example, a light-turned-off state or a high-luminance lighting state) (a comparison between the values at times t21 and t23 or a comparison between the values at times t22 and t24), and the determination of failure detection may be performed only if the result of the comparison falls within a predetermined range. This can prevent erroneous detections due to interruption of sunlight or illumination light by movement of humans or objects.

Further, it is possible to provide a shield section which interrupts the infrared rays entering the infrared-ray detection unit 6 from the upper surface of the top plate 2 while the failure detection unit 9 performs the failure detection. This enables failure detection only based on the amount of radiation of infrared rays which is based on the amount of light emission from the light emitting unit 8, thereby improving the accuracy of the failure detection. The shield section is only required to have a structure which prevents infrared rays from the top plate 2 from entering the infrared-ray detection unit 6. For example, the shield section may be a movable shield plate provided between the lower surface of the top plate 2 and the infrared-ray incidence section 6*a*. Moreover, it is possible to realize a shield section by making the orientation of the infrared-ray detection unit 6 variable.

Note that, while, in the present embodiment, there has been described an induction cooker having a heating coil 3, the failure detection can be applied to other cooking devices, provided that the cooking devices have an infrared-ray detection unit 6 and an infrared-ray temperature calculation unit 7. For example, the failure detection can be applied to a high-frequency heating cooking device, a halogen cooking device and the like.

INDUSTRIAL APPLICABILITY

The induction cooker according to the present invention is capable of detecting failures in an infrared-ray detection unit with excellent accuracy and, therefore, is usable as a cooking device to be frequently used in ordinary households or restaurants.

The invention claimed is:

1. An induction cooker comprising:

a top plate made of a material capable of transmitting an infrared ray;

a heating coil operable to heat a pan placed on the top plate;

a control unit operable to control electric power supplied to the heating coil;

an infrared-ray detection unit that includes an infrared-ray incidence section under the top plate to detect an infrared ray entering the infrared-ray incidence section, the infrared ray being radiated from a bottom surface of the pan, passing through the top plate, and entering the infrared-ray incidence section;

a temperature calculation unit operable to calculate a temperature of the bottom surface of the pan based on an output of the infrared-ray detection unit;

a light emitting unit operable to emit light with a first luminance near the infrared-ray incidence section when viewed from above the top plate, by irradiating a back surface of the top plate from below the top plate with light, to indicate a position of the infrared-ray incidence section; and a failure detection unit operable to detect a failure in the infrared-ray detection unit based on an amount of a change of an output of the temperature calculation unit which is based on an output of the light emitting unit;

wherein the light emitting unit includes a luminance changing section operable to change the luminance of the light emission, and the failure detection unit controls the light emitting unit to emit light with a second luminance higher than the first luminance and detects a failure in the infrared-ray detection unit based on whether or not an amount of an increase in the output of the temperature calculation unit falls within a predetermined range.

2. The induction cooker according to claim 1, wherein the failure detection unit performs failure detection by controlling the light emitting unit to turn off the light.

3. The induction cooker according to claim 1, wherein the failure detection unit performs failure detection a plurality of times by controlling the light emitting unit to blink on and off.

4. The induction cooker according to claim 1, wherein the failure detection unit acquires a plurality of output values from the infrared-ray detection unit which are based on a predetermined amount of light emission from the light emitting unit and performs failure detection only when the output values from the infrared-ray detection unit fall within a predetermined range.

5. The induction cooker according to claim 1, further comprising a shield section operable to interrupt the infrared ray entering the infrared-ray incidence section from the top plate while the failure detection unit performs failure detection.

6. The induction cooker according to claim 1, wherein the failure detection unit performs failure detection immediately before the control unit starts heating.

7. The induction cooker according to claim 1, wherein the control unit stops heating when the failure detection unit determines that there is a failure in the infrared-ray detection unit.

8. The induction cooker according to claim 1, further comprising a notification section operable to give notice that there is a failure in the infrared-ray detection unit when the failure detection unit determines that there is a failure in the infrared-ray detection unit.

* * * * *